United States Patent [19]

Banks, Jr.

[11] 4,047,377

[45] Sept. 13, 1977

[54] SLEEP-INDUCING/INTERRUPTING AUDIO SYSTEM

[76] Inventor: Holly Banks, Jr., 4046 St. Monica Drive, Baltimore, Md. 21222

[21] Appl. No.: 660,988

[22] Filed: Feb. 24, 1976

[51] Int. Cl.[2] ..... G04B 37/12

[52] U.S. Cl. ..... 58/152 B; 58/24 R; 330/130; 340/384 E

[58] Field of Search ..... 179/1 AA, 1 P, 5 P, 179/5 R; 340/384 R, 309.1; 58/152 R, 152 B, 16 R, 16 D, 14; 330/129, 130, 135, 1 R; 325/396

[56] References Cited

U.S. PATENT DOCUMENTS

| | | | |
|---|---|---|---|
| 2,304,095 | 12/1942 | Hull | 340/384 E |
| 2,575,990 | 11/1951 | Augustadt | 330/130 X |
| 2,616,971 | 11/1952 | Kannenberg | 330/130 X |
| 3,290,442 | 12/1966 | Suganuma | 179/1 P |
| 3,567,863 | 3/1971 | Morrissey | 179/1 AA |
| 3,873,921 | 3/1975 | Petrinec | 58/24 R X |

*Primary Examiner*—Ulysses Weldon
*Attorney, Agent, or Firm*—John F. McClellan, Sr.

[57] ABSTRACT

For sleep promotion and for sleeper awakening an audio system including a wide band audio frequency generator is provided with an output speaker, volume and tone selectors, a time-alarm signalling system, and means for connection with a house alarm system to sound the time-alarm when the house alarm system is actuated; operation is suspended when the alarm system is actuated for any reason; volume control in response to ambient noise is also provided.

3 Claims, 1 Drawing Figure

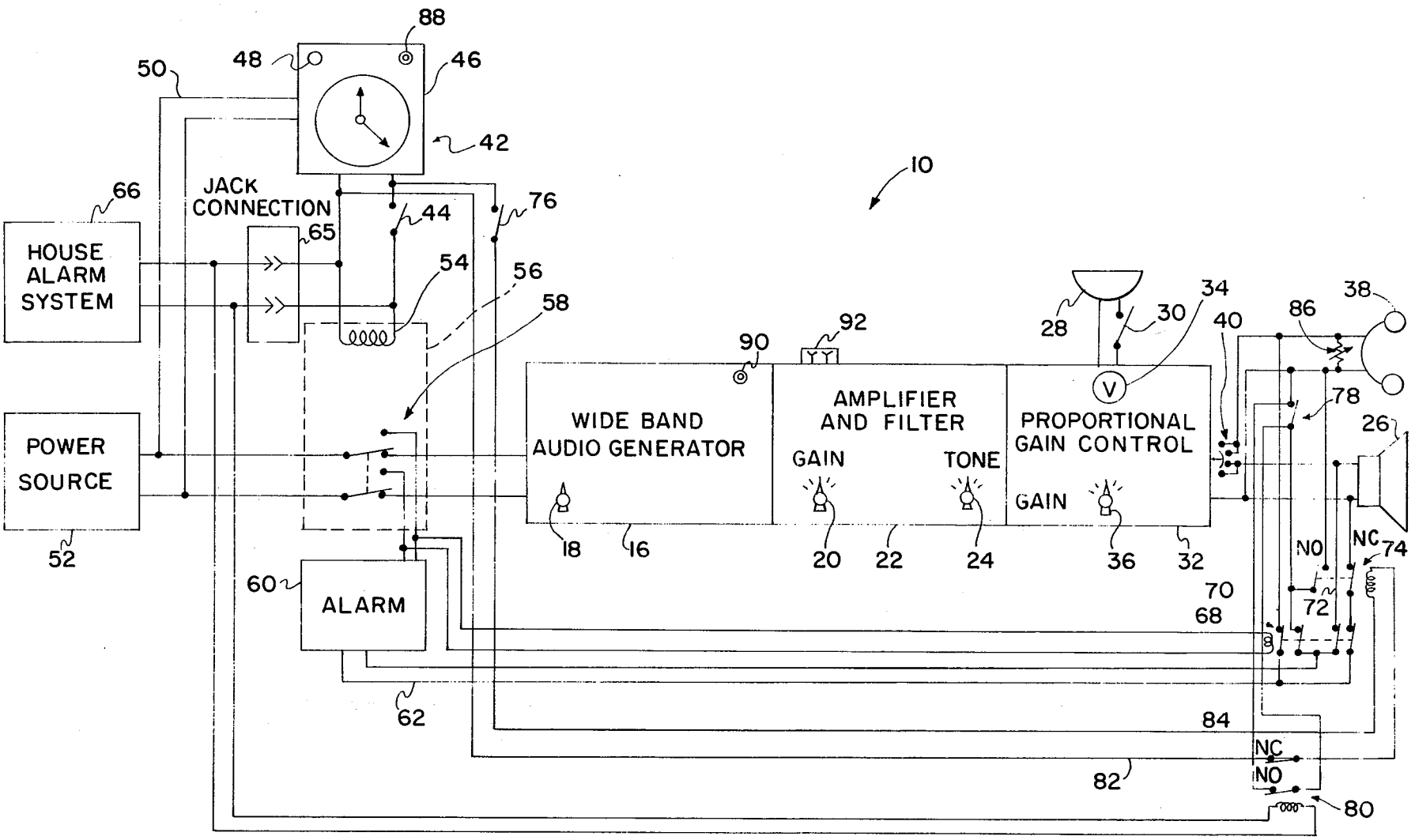
PROPORTIONAL GAIN CONTROL
GAIN
AMPLIFIER AND FILTER
TONE
GAIN
WIDE BAND AUDIO GENERATOR
ALARM
JACK CONNECTION
HOUSE ALARM SYSTEM
POWER SOURCE
NC
NO
NC
NO
10
18
20
22
24
26
28
30
32
34
36
38
40
42
44
46
48
50
52
54
56
58
60
62
65
66
68
70
72
74
76
78
80
82
84
86
88
90
92

SLEEP-INDUCING/INTERRUPTING AUDIO SYSTEM

This invention relates generally to acoustical generation systems and particularly to an acoustical system for promoting and interrupting sleep.

Although the system is described in reference to human beings, it will be recognized that in appropriate circumstances the system may also be employed to benefit domestic animals. Humans may also use the system to aid concentration while in noisy surroundings.

A principal object of the invention is to provide a sleep inducing system producing an even sonorous hum which acts to counteract distractive noises in the vicinity of the person employing the system and which is adjustable in pitch for better adjusting to mask noises of different origins.

A further object of the invention is to provide a system as described with means for responding to changes in ambient noise level by correspondingly changing the volume of the hum. Still further objects are to provide a system as described which has a coacting alarm clock system for interrupting sleep at a predetermined time, and a provision for setting off the alarm of the clock system upon actuation of an external or house system such as a burglar alarm, smoke alarm or the like, and in event of alarm for any cause for suspending emission of the hum-like sound.

And yet further objects are to provide a system as described which economically employs existing well-known devices and techniques in assemblage to produce new, unobvious and useful results.

In brief summary given for purposes of cursive description and not as limitation, the invention includes means for emitting a uniform acoustic signal, means for raising or lowering the tone or frequency of the signal, means for adjusting the volume of the signal including means responsive to ambient sound levels, and means for sounding an alarm, in the preferred embodiment suspending said signal emission upon sounding the alarm.

The above and other objects and advantages of the invention will become more readily apparent on examination of the following description including the drawing.

The FIGURE illustrates in diagrammatical form the system of this invention.

Referring in detail to the FIGURE, to use the system 10 in the simplest mode, to provide a constant lulling sound, the user turns on audio generator 16 at switch 18, adjusts the gain control knob 20 on audio amplifier 22, and the tone or frequency band knob 24, on the audio amplifier, and settles down to sleep, listening to the output of speaker 26.

To compensate for uneven levels of distracting sounds in the vicinity, the user can connect microphone 28 through switch 30 to proportional gain control unit 32, so that as the average extraneous sound level rises or falls, the sound output of the audio system rises and falls correspondingly, preventing the generated sound from being overpowered distractingly. The level of the ambient sound can be read as microphone output on voltmeter 34 and the proportional amplification adjusted at gain control knob 36. If desired, earphones 38 may be selected at switch 40 in place of the speaker, or both together may be used for the hum output.

Alarm clock system 42 may be selected at clock alarm switch 44 to provide for awakening the user at a time preset by conventional apparatus including clock 46 and setting knob 48. Upon reaching the predetermined time, the clock may, through connection 50 with any suitable source 52 or power for the system, energize coil 54 of relay 56, throwing relay switch 58 to normally open position (up in the diagram) disconnecting the hum-generation system and energizing alarm 60, which sounds through the speaker through appropriate connections 62 through both the earphones and the speaker, if desired.

Jack 65 permits plugging a house-alarm system 66 such as a burglar alarm or a smoke detector alarm into the audio system in parallel with the clock, but bypassing the clock alarm switch. Upon actuation, this results in sounding an alarm through the earphones and speaker in the same manner as the clock alarm switch.

The speaker circuit and the output from the hum system may be advantageously separate until the alarm sounds, as by four-pole single throw normally open relay 68, the coil circuit of which is energized through relay 58 and the contacts of which relay the alarm signal from paired lines 62 through paired lines 70 to the earphones and paired lines 72 to the speaker.

If desired, the clock alarm may be directed through the earphones only by means of the normally closed contact of relay 74 which in response to clock 46 through switch 76 interrupts the alarm circuit to one side of the speaker.

To prevent the clock alarm from being inadvertently turned off from the earphones at selector switch 78, at the same time that the speaker is turned off by relay 74, a normally open contact of relay 74 is closed on actuation of the relay, bypassing earphone switch 78. To insure that both earphones and speaker respond to a house alarm, relay 80 is provided with coil circuit responsive to the house alarm, one normally closed contact which on actuation of the house alarm drops relay 74 out of the circuit by interrupting one of paired lines 82 from the clock, and which at the same time through a normally open contact bypasses earphone switch 78 through line 84.

Other features observable are that volume control 86 provides for independent adjustment of earphone level, system-on lights 88, 90 are provided, and also jacks 92 on the amplifier for plugging-in tape players and extra speakers as appropriate.

No claim is made to invention of any of the subcomponents of the system, nor to the exact type connection. Any components and any connections may be employed which result in the coactive functions set out.

Power may be A-C or D-C, house current or battery, as desired and suitable. Any electric alarm clock which upon time adjustably set powers a solenoid-type alarm may be used to actuate the relay. For the alarm, any suitable oscillator/amplifier system may be used to generate an audio signal for broadcast by the speaker.

Noise generators for audio frequencies are well known and may be purchased or may be built, the principles set out in such publications as the Radio Amateur's Handbook being employed (American Radio Relay League, Newington, Conn. 06111, the forty-sixth edition setting out general principles and Schematics on pages 542–547). Alternatively, tape loops with recordings of heavy waterfalls may be employed, the desired frequencies from the low hearing-range through approximately ten thousand cycles per second being present.

Audio amplifiers also are available, and are well described, if it is desired to construct them, in the same Radio Amateur's Handbook, as are band pass filters for tone control.

Although microphone gain control circuits for modulating carrier waves have long been known, in the present application it is important to prevent feedback by isolating the microphone from the speaker or speakers, since both "woofers" and "tweeters" may advantageously be used for optimum response. Isolation may be achieved by physically separating the microphone and speaker, by alternate blanking, or by frequency isolation as by limiting the speaker range and turning the microphone to be non-responsive in the range limited.

It can be seen that the user can flexibly adjust the system by ear for maximum comfort, and can build a record by noting previous settings and the present level indicated by his instrument, so that setting can be made quickly on the basis of previously experienced noise environment.

It can be seen further that provision of the earphones permits lowering the signal level and entirely prevents annoying others. Also, it can be seen that the alternative earphone/speaker user connection coupled with the speaker-only alarm connection prevents damaging the ears while wearing earphones, while insuring an alarm for all in the vicinity, including the earphone wearer who ceases to hear the hum at the instant the alarm sounds, when the house alarm sounds.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by United States Letters Patent is:

1. A sleep-inducing/interrupting audio system comprising: means for emitting a uniform audible hum-like signal for inducing sleep, means for adjusting the signal to mask ambient sounds, including means for adjusting signal tone and volume, means for sounding an alarm to interrupt sleep, including means for stopping said signal upon the sounding of the alarm, the means for sounding an alarm having connection for sounding said alarm through the speaker and including a clock having means for commencing the alarm sounding at an adjustably predetermined time, and the means for sounding the alarm further including connection for sounding the alarm through origination by a source such as a burglar alarm external to the audio system.

2. A sleep-inducing/interrupting audio system comprising: means for emitting a uniform audible hum-like signal for inducing sleep, means for adjusting the signal to mask ambient sounds, including means for adjusting signal tone and volume, means for sounding an alarm to interrupt sleep, including means for stopping said signal upon the sounding of the alarm, the means for sounding an alarm having connection for sounding said alarm through the speaker, earphones included in the system, and means for alternatively selecting earphones or speaker, the means for selecting earphones having means for preserving said connection for sounding the alarm through the speaker.

3. A sleep-inducing/interrupting audio system comprising: means for emitting a uniform audible hum-like signal for inducing sleep, means for adjusting the signal to mask ambient sounds, including means for adjusting signal tone and volume, means for sounding an alarm to interrupt sleep, including means for stopping said signal upon the sounding of the alarm, the means for sounding an alarm including both a clock having means for commencing the alarm sounding at an adjustably predetermined time and an external alarm system, a speaker in the audio system; earphones in the audio system, means for sounding said alarm by the clock selectively through the speaker, the earphones, or both speaker and earphones; and means for insuring sounding of alarm through both speaker and earphones when sounded by the external alarm system.

* * * * *